United States Patent [19]

Giacchetti

[11] 4,314,530

[45] Feb. 9, 1982

[54] AMPLIFIED RADIATION IGNITER SYSTEM AND METHOD FOR IGNITING FUEL IN AN INTERNAL COMBUSTION ENGINE

[76] Inventor: Anacleto D. Giacchetti, 13100 Maple Ave., Lemont, Ill. 60439

[21] Appl. No.: 124,592

[22] Filed: Feb. 25, 1980

[51] Int. Cl.[3] ..... F02P 23/04

[52] U.S. Cl. ..... 123/143 R; 123/143 B

[58] Field of Search ..... 123/143 B, 143 R; 60/39.82 R; 431/258, 1

[56] References Cited

U.S. PATENT DOCUMENTS

| | | | |
|---|---|---|---|
| 3,427,118 | 2/1969 | Andress et al. | 431/258 |
| 3,574,501 | 4/1971 | Mitts | 431/258 |
| 3,618,526 | 11/1971 | Baker | 60/39.82 R |
| 3,861,371 | 1/1975 | Gamell | 123/143 R |

FOREIGN PATENT DOCUMENTS

| | | | |
|---|---|---|---|
| 2207392 | 8/1973 | Fed. Rep. of Germany | 123/143 B |
| 1236561 | 6/1971 | United Kingdom | 123/143 B |
| 1360196 | 7/1974 | United Kingdom | 123/143 B |

OTHER PUBLICATIONS

Lindsley, "More Miles from a barrel of crude", Popular Science, Sep. 1979, pp. 74–78.

*Primary Examiner*—Charles J. Myhre
*Assistant Examiner*—Andrew M. Dolinar

[57] ABSTRACT

An amplified radiation igniter system initiates the ignition of a fuel/air mixture retained within a combustion chamber of an internal combustion engine. The amplified radiation, usually supplied in beam form according to appropriate timed intervals, is directed from a source for such radiation through a delivering conduit to a connecting member which directs the radiation beam into the combustion chamber. When the radiation provided has sufficient intensity, it will ignite the fuel/air mixture in accordance with the method of this invention. The radiation beam penetrates deep into the mixture traversing the width of the combustion chamber. The mixture absorbs radiant energy from the radiation beam and ignites at many points along the travel path of the radiation. In order to facilitate the extent of combustion, the total amount of interface between the radiation beam to fuel/air mixture is increased by any of a number of methods such as, using multiple radiation beams from multiple sources in a single combustion chamber, reflecting the radiation beam within the combustion chamber, or splitting the beam into several lesser beams within the combustion chamber. This system and method for igniting the fuel/air mixture within an internal combustion engine provides an efficient and clean combustion that occurs almost instantaneously at many points within the combustion chamber once a pulse of radiation is released into the chamber. This system and method enables the engine to operate on leaner mixtures of fuel to air and on low octane fuels.

8 Claims, 4 Drawing Figures

FIG. 1
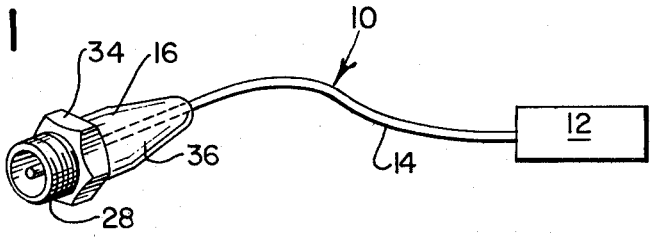
FIG. 2
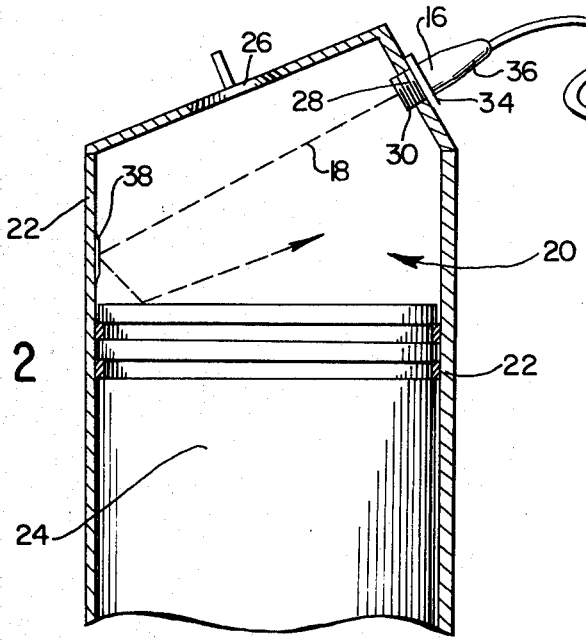
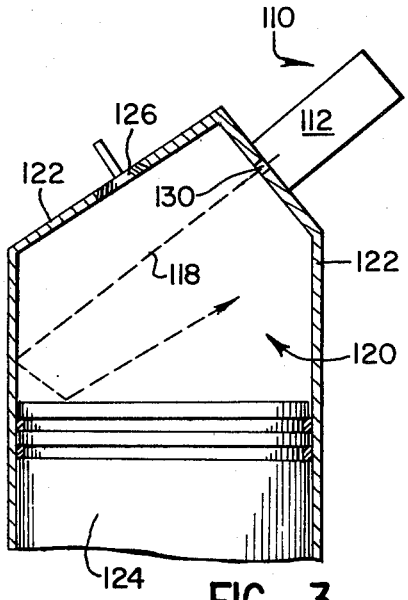
FIG. 3
FIG. 4
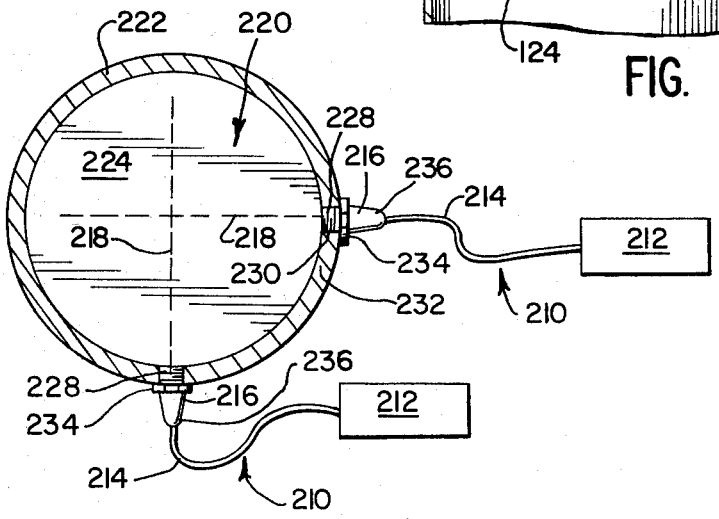

AMPLIFIED RADIATION IGNITER SYSTEM AND METHOD FOR IGNITING FUEL IN AN INTERNAL COMBUSTION ENGINE

FIELD OF THE INVENTION

This invention is directed to systems and methods for initiating ignition of the fuel in internal combustion engines and more particularly to ignition initiated by amplified, high-intensity radiation.

BACKGROUND OF THE INVENTION

Internal combustion engines have been known for many years and are used in airplanes, automobiles, and other vehicles, as well as for some industrial purposes. The internal combustion engines of today were developed at a time when fuel supplies were believed to be infinitely plentiful. As a result, these engines operate in a manner which is now considered inefficient and wasteful of limited fuel resources.

A great deal of time and research is presently being devoted to improving the efficiency and decreasing the fuel consumption of internal combustion engines.

The gasoline powered engine typically used today has been designed to require high-octane gasoline. A gasoline rich mixture of gasoline and air is ignited within the cylinder by a spark produced by an electrically operated spark plug. However, only the mixture in the immediate vicinity of the spark ignites, and a flame front moves out from the spark plug. As the flame front proceeds, it compresses the unburned mixture. If the octane of the unburned mixture is not sufficiently high, the compressed mixture may detonate causing a loud knocking noise and reducing the efficiency of the engine. To eliminate the detonation-engendering flame front a high octane fuel is required, but such fuel is costly to refine and lesser amounts are produced per barrel of crude oil than lower octane fuels. Because of these problems research has proceeded in an effort to develop internal combustion engines that operate more efficiently and more cleanly on lower octane fuels.

A development that is still in the experimental stages is the plasma-jet ignition developed by Professor A. K. Oppenheim at the University of California at Berkeley which is described in the September 1979 issue of *Popular Science* beginning at page 74. The plasma-jet ignition utilizes an ionized plasma which is injected into the combustion chamber. Initially, the ion cloud penetrates into the chamber and expands. As it expands very little combustion occurs. When the ion cloud has expanded sufficiently, combustion proceeds rapidly from many ignition points rather than from a single spark because the plasma comprises hot, highly charged particles. In this manner, almost the entire charge is ignited and burns smoothly. There is no flame front which propagates from a single spark. Thus, the plasma-jet ignition permits the use of lower octane fuels and much leaner mixtures of fuel and air than internal combustion engines using conventional spark plug ignition. However, the plasma-jet ignition is not yet commercially feasible for operating an engine.

In the same article of the September 1979 issue of *Popular Science,* another recent development is described which is called the controlled-combustion system. Combustion is initiated in this system by simultaneous fuel injection and spark ignition. By injecting the fuel into the vicinity of the spark, the air within the combustion chamber is caused to swirl about the chamber. The products of combustion, the flame front, and the combustible mixture are swept downstream and away from the spark by the air swirl. In this manner, cylinder pressure builds at a controlled rate. The spark is discontinued, but fuel injection continues to feed the swirling flame front until the maximum power is reached. The fuel injection is then discontinued and the intensity of the flame front fades, but combustion continues until all of the fuel is consumed. This system has no octane requirements and operates efficiently and cleanly on a leaner fuel/air mixture than conventional spark plug ignited internal combustion engines require.

Lasers or other sources of amplified light have been used in conjunction with ignition systems. The beam of amplified light produced by a laser has been utilized as part of various timing devices which actuate a mechanism which produces ignition sparks. Similar to contacts in a distributor used in connection with a conventional ignition system, light pulses are used to provide timed contacts with a device that senses the light pulse and provides an electrical signal for initiating each spark. However, the light pulse does not contact the fuel/air mixture which is ignited.

In some solid fuel rockets, lasers have been used to ignite a solid propellant igniter or to simultaneously ignite several such igniters. The amplified light is directed at the igniter with an intensity sufficient to ignite the solid propellant possessed by the igniter. The igniter in turn then ignites the solid fuel within the rocket at a predetermined rate.

A high intensity beam of light from a ruby laser has been used to ignite a very lean 1:1000 oil to air mixture in a boiler. The beam has energy density sufficient to maintain combustion in the oil/air mixture volume after the laser impulse terminates. Each laser impulse occurs only when needed to initiate combustion for maintenance of the desired boiler temperature.

In each of the mentioned fuel ignition systems, and for that matter, in every ignition system, it is critical that the timing and rate of ignition be controllable or, at least, predictable so that the energy released by the combustion of the fuel may be harnessed in an efficient manner. It is also important to the preservation of our environment and conservation of our resources that the fuel burn cleanly and as completely as possible. Accordingly, an engine that operates efficiently on a leaner mixture of fuel and air than usual is desirable because it conserves fuel and reduces harmful emissions.

The amplified radiation igniter system of the present invention eliminates many of the problems presented by the currently used igniter systems and achieves many of the results desired in improving the operation of internal combustion engines.

Accordingly, it is an object of this invention to provide an igniter system that initiates a cleaner and more efficient combustion than conventional spark plug ignition systems.

Another object of the present invention is to provide an amplified radiation igniter system which ignites the fuel within the combustion chamber at many points along the path of the radiation almost instantaneously (i.e., at or near the speed of light).

A further object of the invention is to provide an ignition system that operates efficiently when the engine is provided with a mixture of fuel to air that is leaner in fuel than mixtures required by conventional spark plug ignition systems.

Still another object of the present invention is to initiate combustion of a fuel/air mixture within the combustion chamber of an internal combustion engine with amplified radiation provided by a laser or maser.

Another object of the present invention is to provide combustion initiating radiation pulses to the combustion chamber of an internal combustion engine via flexible radiation transmitting fibers.

Other objects and advantages of the invention will become apparent upon the reading of the following detailed description and appended claims, and upon reference to the accompanying drawings.

SUMMARY OF THE INVENTION

The amplified radiation igniter system of this invention comprises a source of amplified, high-intensity radiation, a conduit for delivering the radiation to the combustion chamber, and a connecting member. The radiation is usually provided in beam form and the source of radiation may be a laser (light amplification by stimulated emission of radiation) or a maser (microwave amplification by stimulated emission of radiation), so long as the intensity of the radiation provided is sufficient to penetrate deep within a combustion chamber and ignite a fuel/air mixture. The radiation delivering conduit connects the radiation source to the combustion chamber and may be of any suitable type. It may comprise a series of reflecting surfaces that direct the radiation beam on a tortured path from the radiation source to the combustion chamber, or it may comprise a rigid, straight-lined conduit, or even a flexible conduit such as a glass fiber which carries such radiation. The connecting member couples the beam delivering conduit to the combustion chamber and directs the angle of entry of the radiation beam into the combustion chamber.

The present invention operates on a principle that the fast-moving, high-intensity radiation will penetrate into the combustion chamber igniting the fuel/air mixture along its path. The amplified, high-intensity radiation, usually in beam form, traverses the combustion chamber and some of its radiant energy is absorbed by the fuel/air mixture causing it to ignite. Because the radiation beam travels at or near the speed of light, ignition of the fuel/air mixture occurs almost instantaneously all along the path of the beam. In this manner, the fuel/air mixture burns more completely and therefore more cleanly than with conventional spark ignited internal combustion engines.

BRIEF DESCRIPTION OF THE DRAWINGS

For a more complete understanding of this invention, reference should now be made to the embodiments illustrated in greater detail in the accompanying drawings and described below. In the drawings:

FIG. 1 is a perspective view of an insulated connecting member coupled to a radiation source, symbolically represented by a box, by a flexible radiation delivering conduit;

FIG. 2 is an elevational view of a combustion chamber with a portion of a cylinder in vertical section and a piston in the course of a stroke showing a reflecting surface opposite the point of entry of a radiation beam into the cylinder;

FIG. 3 is an elevational view of an alternative combustion chamber with a portion of its cylinder in vertical section and its piston in the course of a stroke showing an embodiment in which the radiation source is directly coupled to the combustion chamber; and, FIG. 4 is a top plan view of an alternative combustion chamber with its cylinder shown in horizontal section showing crossing radiation beams discharged from two connecting members.

DETAILED DESCRIPTION OF THE PREFERRED EMBODIMENTS

Referring generally to the drawings, an amplified radiation igniter system 10 is shown in FIG. 1. It may be used singly, or it may be used in combination with other ignition systems (not shown) to initiate and maintain combustion within an internal combustion engine. The igniter system 10 has a source of coherent radiation 12, a radiation delivering conduit 14, and a connecting member 16. Coherent radiation 18, as shown in FIG. 2 and designated by dashed lines, is usually provided in beam form and may be light radiation, microwave radiation or any other coherent radiation produced by stimulated emission which is capable of igniting a fuel/air mixture. The igniter system 10 is coupled to a combustion chamber 20 defined by a cylinder 22, a piston 24, and a valve 26 by attachment means provided on the connecting member 16.

The radiation source 12 may comprise a laser or a maser of any suitable type or any other source of coherent radiation which provides amplified, high-intensity coherent radiation 18 which will ignite a fuel/air mixture. A laser or maser operates to provide coherent radiation under a generally known stimulated emission process. In principle, if the energy difference between the normal and first excited state of an atom is E, the atom is capable of absorbing a photon whose frequency f is given by the Planck equation $E=hf$ where h is Planck's constant. By absorbing the photon, the atom enters its first excited state and will remain in that excited state for a short time. Thereafter, spontaneous emission occurs and the excited atom returns to its normal state by emitting a photon having the same frequency as the photon which was originally absorbed. However, the photon is emitted in a random direction and with a random phase. In order to overcome random photon emission, the aforementioned stimulated emission process is utilized. Stimulated emission takes place when a photon encounters an excited atom and forces it to emit another photon of the same frequency, in the same direction, and in the same phase. Thus, two photons are emitted as coherent radiation.

Under normal conditions, the population of atoms in the normal state far exceeds the population of atoms in the exited state within a given confined area. If, for example, a beam of intense light is directed into the area, the rate at which energy is extracted from the beam by absorption by normal atoms greatly outweighs the rate at which energy is added to the beam by stimulated emission by the excited atoms. Therefore, a population inversion of excited atoms over normal atoms is required so that the rate at which energy is added to the beam is greater than that extracted by absorption. Typically, a population inversion is accomplished by a procedure known as "optical pumping" wherein a very strong beam of radiation or an intense electrical discharge within the area provides metastable atoms (atoms in a second excited state near the first excited state and having a long lifetime in the second state) which act as a feeder to the atoms in the excited state. The net effect of the processes of population inversion by optical pumping and of stimulated emission in a laser is a beam of amplified light radiation that is very intense, almost perfectly parallel and monochromatic, and spatially coherent at all points within a given cross section. Similarly, a maser provides for the amplification of microwaves.

In the present invention, the radiation source 12 is coupled to a source of power, not shown, and is actuated by a timing mechanism, also not shown, which regulates the frequency and duration of each pulse of radiation 18 according to the operation needs of the engine. Thus, a pulse of radiation 18 may be provided which will last, for example, 100 milliseconds; this is a duration which is considerably longer than the usual one millisecond or less duration of a spark in a spark initiated ignition system. If the igniter system 10 of this invention is for an internal combustion engine in a vehicle, a portable source of power is provided.

The radiation 18 discharged from the radiation source 12 has an intensity sufficient to ignite a mixture of fuel and air within the combustion chamber 20, but not to damage the inner surfaces of the cylinder 22 or the piston 24. For example, a beam of radiation 18 having a temperature near 800° C. will ignite most gas/air mixtures, but will not damage the inner surface of a cylinder 22 because such cylinders are typically capable of withstanding temperatures approaching 2000° C. It is preferred, however, that the radiation 18 be amplified to have an intensity sufficient to ignite a mixture of fuel and air which is much leaner than mixtures required by internal combustion engines currently in use. For example, it is believed that a mixture of air to fuel as high as 30:1 will ignite when radiation 18 is provided in accordance with this invention at approximately 800° C.; whereas, a spark initiated ignition system usually operates when the mixture of air to fuel is in the vicinity of 15:1 or less. To further facilitate reflection of the radiation beam 18 and to protect the inner surface of the cylinder 22, a reflecting surface 38 may be provided (See FIG. 2).

In a preferred embodiment of this invention, the radiation source 12 is coupled to the combustion chamber 20 by a connecting member 16. The connecting member 16 attaches to the cylinder 22 in any suitable manner. This attachment may be accomplished by threaded engagement as illustrated in FIG. 2. When this is the case, the connecting member 16 is provided with a male threaded base 28 and the cylinder 22 has a bore or aperture 30 in its wall which is provided with female threads 32 for receiving the male threaded base 28 of the connecting member 16. It is preferred that the connecting member 16 have a basic structure similar to a conventional spark plug, i.e., having a threaded base 28, a sleeve 34 for tightening the connecting member 16 into the wall of the cylinder 22, and an insulating jacket or casing 36 (See FIG. 1). In this manner, conversion from the current spark plug ignition system to the amplified radiation igniter system of this invention is more readily accomplishable.

The connecting member 16 receives the radiation 18 discharged from the radiation source 12 and directs the radiation 18 into the combustion chamber 20. Intermediate and coupling together the connecting member 16 and the radiation source 12, it is preferred that there by provided a radiation delivering conduit 14. The delivering conduit 14 is of any type suitable for carrying high-intensity coherent radiation from the radiation source 12 to the connecting member 16.

It is preferred that the delivering conduit 14 comprise a single flexible glass fiber, as shown in FIGS. 1–3, or a multiplicity of fine hair-like glass fibers when the radiation used for ignition is light radiation. When a multiplicity of glass fibers is utilized, however, a device within the connecting member 16 (e.g., a lens), not shown, for focusing the separate beams into an intense single coherent beam may be added in order to achieve the intensity necessary to initiate combustion. The transmission of light energy through flexible glass fibers is accomplished via a phenomenon known as total internal reflection. In actuality, the light rays passing through the curved glass fibers do not bend, but rather follow a zigzag path always traveling in straight lines and caroming repeatedly off the surface of the fiber. Each fiber is usually constructed of a cylindrical glass core with a high index of refraction encircled by a thin coating of glass with a low index of refraction. Since the refraction of light rays, when traveling from a medium in which the speed of light is of lower velocity (e.g., glass with a high index of refraction) to a medium of higher velocity (e.g., glass with a low index of refraction) will bend from the perpendicular toward the fiber surface, there is an angle which is the angle of incidence where the refracted ray bends 90° from the perpendicular and travels the interface of the two mediums. This angle of incidence is called the critical angle. Thus, at angles of incidence greater than the critical angle no light passes into the second medium but is entirely reflected internally. Virtually no light energy is lost in this total internal reflection; however, some is lost through absorption by the high-refraction glass. Accordingly, so long as the light rays enter the glass fiber at an angle of incidence greater than the critical angle and the fiber itself is not bent so as to create an angle of incidence through reflection which is less than the critical angle, the light energy not absorbed by the glass will travel the length of the fiber.

In a similar manner, the delivering conduit 14 may comprise wave-guides, well-known in the art, which can be used to convey microwave radiation from the radiation source 12 to the connecting member 16.

It is to be understood, however, that other types of conduits may be used. For example, a straight-line conduit may be used wherein the beam of radiation 18 travels in a straight line directly into the combustion chamber 20 and the conduit serves only to shelter the direct beam, and a conduit may be used having internal reflecting surfaces such as ordinary opaque mirrors which direct the beam of radiation 18 through a plurality of angular reflections along a tortured path from the radiation source 12 to the combustion chamber 20. However, when mirrors are used, a considerable amount of energy is absorbed at the mirror surface thereby reducing significantly the efficiency of this type of delivering conduit 14.

An alternative embodiment of the amplified radiation igniter system of the present invention is illustrated at 110 in FIG. 3 and has a radiation source 112 directly coupled with a cylinder 122, thus, eliminating the need for any delivering conduit 14 (shown in FIGS. 1 and 2). This embodiment requires that a separate radiation source 112 be provided for each combustion chamber 120. In accordance with this invention and similar to the embodiment shown in FIG. 2, the igniter system 110 comprises the coherent radiation source 112 which provides a beam of coherent radiation 118 directed through a bore or aperture 130 in the cylinder 122 into the combustion chamber 120. The combustion chamber 120 is defined by the cylinder 122, a piston 124, and a valve 126.

Another alternative embodiment of the amplified radiation igniter system of the present invention is set forth at 210 in FIG. 4 and has multiple beams of radiation 218 discharged into a combustion chamber 220. FIG. 4 shows one form of this embodiment which is crossing beams of radiation 218 as discharged from separate igniter systems 210. With this embodiment, each igniter system 210 has a radiation source 212 which provides a beam of radiation 218, a delivering conduit 214 and a connecting member 216. The beams of radiation 218 are directed into the combustion chamber 220 which is defined by a cylinder 222, a piston 224, and a valve (not shown). Similar to the principal embodiment illustrated in FIGS. 1 and 2, each connecting member 216 of this alternative embodiment is provided with a male threaded base 228 and the cylinder 222 has a plurality of bores or apertures 230 which are provided with female threads 232 for receiving the male threaded base 228 of the connecting member 216. Also, each connecting member 216 has a basic structure similar to a convention spark plug comprising the threaded base 228, a sleeve 234 for tightening the connecting member 216 into the cylinder 222, and an insulating jacket or casing 236. This insulating casing receives the delivering conduit 214 and can also house a device such as a lens, not shown, for focusing a plurality of beams of radiation 218. By providing multiple igniter systems 210 for a single combustion chamber 220, a more complete combustion is assured in comparison to when a single igniter system 210 is utilized, but, of course, both forms provide advantages over spark ignitions.

In operation, the amplified radiation igniter system 10 of the present invention ignites a fuel/air mixture in a combustion chamber 20 of an internal combustion engine by discharging high-intensity, coherent radiation 18 into the combustion chamber 20. The radiation 18 provided by the radiation source 12 is directed into the combustion chamber 20 and amidst the awaiting fuel/air mixture by the connecting member 16 and the delivering conduit 14. When the radiation 18 has a sufficient intensity, it will penetrate into the volume of the combustion chamber 20 several magnitudes deeper than the conventional spark plug spark and may even traverse the entire width of the chamber 20 and reflect off of the opposite side before its energy is reduced by absorption to a point where it will no longer initiate ignition of the fuel/air mixture. The reflecting surface 38 may be provided, as shown in FIG. 2, to facilitate the reflection of the radiation 18 and increase the surface area of ignition within the combustion chamber 20. Thus, a beam of radiation 18 capable of igniting a fuel/air mixture penetrates into the combustion chamber 20 and ignites the mixture at a multiplicity of places all along its travel path. The total surface area of ignition is considerably increased over the conventional single spark ignition and this provides the advantages of cleaner and more thorough combustion. Another advantage provided is that there is little danger that the flame initiated by the beam of radiation 18 and propagating out from its travel path will die out or that combustion will stop before it is completed when a mixture as lean as 30:1 is utilized. By comparison, having the flame front die out and incomplete combustion are problems encountered by conventional spark plug ignitions when a fuel/air mixture as lean as 15:1 is used.

Since the radiation 18 travels at or near the speed of light, ignition of the fuel/air mixture occurs almost instantaneously at numerous points along the radiation 18 travel path, and the fuel/air mixture burns more completely because the flame front propagates from almost the entire travel path of the radiation 18 rather than from a single ignition spark. Thus, the flame front does not have the opportunity to form in a manner which will cause detonation. This enables the engine to run on a leaner mixture and a lower octane fuel than may be used with conventional spark ignitions and still achieve the desired power from the expanding gases due to combustion.

One alternative means by which the number of places at which ignition is initiated can be increased is by providing a conventional beam splitting element which separates a single beam into multiple beams. This element, not shown, may be positioned at any point in the path of the beam of radiation 18 and is coupled to the combustion chamber 20 or the connecting member 16. Since the beam splitting element divides the main beam of radiation 18 into a plurality of lesser beams of radiation 18, each having a different direction of travel, the main beam of radiation 18 must have an intensity high enough so that each of the lesser beams has an intensity sufficient to ignite the fuel/air mixture.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A system for initiating ignition of a fuel-air mixture in a combustion chamber for an internal combustion engine comprising:

at least one radiation producing means for providing a beam of amplified, high-intensity, coherent radiation; said beam having an intensity to ignite said fuel-air mixture in said combustion chamber and having an intensity such that it traverses the width of said combustion chamber;

coupling means for coupling said radiation producing means to a wall of said combustion chamber and directing said beam of radiation into said combustion chamber; and, at least one reflective surface attached to said wall of said combustion chamber for reflecting said beam of radiation within said combustion chamber.

2. A system as set forth in claim 1 wherein said radiation producing means is a laser and said beam of radiation is a beam of light.

3. A system as set forth in claim 2 wherein said beam of light provided by said laser has an intensity such that said beam of light penetrates into said combustion chamber and ignites said fuel-air mixture at a plurality of places along the path of said beam.

4. A system as set forth in claim 1 wherein said radiation producing means is a maser and said beam of radiation is a microwave beam.

5. A system as set forth in claim 4 wherein said microwave beam provided by said maser has an intensity such that said microwave beam penetrates into said combustion chamber and ignites said fuel-air mixture at a plurality of places along the path of said microwave beam.

6. A system as set forth in claim 1 wherein said coupling means comprises:

a fiber means for conveying said beam of radiation from said radiation producing means to said combustion chamber; and, attachment means for receiving and coupling said fiber means to said combustion chamber so that said beam of radiation conveyed by said fiber means is emitted into said combustion chamber.

7. A system as set forth in claim 6 wherein said attachment means comprises a casing and a connection base which detachably extends through an aperture in said wall of said combustion chamber.

8. A system as set forth in claim 7 wherein said connection base has threads and said wall of said combustion chamber receives said connection base in threaded engagement.

* * * * *